US006196131B1

(12) United States Patent
Yanda et al.

(10) Patent No.: US 6,196,131 B1
(45) Date of Patent: Mar. 6, 2001

(54) SHOCK TUBE INITIATOR TIP ENCASED IN A NON-CONDUCTIVE MATERIAL

(76) Inventors: Ronald A. Yanda; John P. Nodine, both of 1395 Hearst Dr., Atlanta, GA (US) 30319

( * ) Notice: Subject to any disclaimer, the term of this patent is extended or adjusted under 35 U.S.C. 154(b) by 0 days.

(21) Appl. No.: 09/350,434

(22) Filed: Jul. 8, 1999

Related U.S. Application Data

(60) Provisional application No. 60/091,998, filed on Jul. 8, 1998.

(51) Int. Cl.[7] ..... C06C 5/06; C06C 5/04

(52) U.S. Cl. ..... 102/275.11; 102/275.8; 102/275.12; 102/202.8; 102/202.9

(58) Field of Search ..... 102/202.8, 202.9, 102/275.8, 275.11, 275.12

(56) References Cited

U.S. PATENT DOCUMENTS

| | | | | |
|---|---|---|---|---|
| 3,754,506 | * | 8/1973 | Parker | 102/202.8 |
| 3,971,320 | * | 7/1976 | Lee | 102/202.9 |
| 4,128,058 | * | 12/1978 | Mixon, Jr. et al. | 102/202.9 |
| 4,306,499 | * | 12/1981 | Holmes | 102/202.9 |
| 4,576,094 | * | 3/1986 | Meador | 102/202.12 |
| 4,621,578 | * | 11/1986 | Valleres et al. | 102/202.9 |
| 5,659,149 | * | 8/1997 | Sutula, Jr. | 102/275.7 |
| 5,703,320 | * | 12/1997 | Lucca et al. | 102/275.7 |
| 6,006,671 | * | 12/1999 | Yunan | 102/275.11 |

* cited by examiner

*Primary Examiner*—Charles T. Jordan
*Assistant Examiner*—Glenda L. Sánchez
(74) *Attorney, Agent, or Firm*—Thomas, Kayden, Horstemeyer & Risley, L.L.P.

(57) ABSTRACT

The present invention provides a non-electric initiator tip for use with a non-electric shock tube initiation device. The initiator tip of the present invention comprises an inner electrode, an outer electrode, and a conductive component electrically coupled to the inner and outer electrodes for applying current to the inner and outer electrodes to thereby cause a percussion spark to be generated. When the initiator tip is connected to an initiation device, the conductive component of the initiator tip is electrically coupled to electronics in the initiation device such that, when the initiation device is actuated, the electronics in the initiation device in conjunction with a power supply cause a voltage differential to be generated between the inner and outer electrodes and a percussion spark to be produced. The percussion spark initiates gun powder contained in a shock tube mounted to the initiator tip. In accordance with one embodiment of the present invention, the initiator tip comprises an inner electrode made of a material having a high melting point, such as, for example, steel/nickel alloys (e.g., stainless steel SS-304, SS-306), chromium/molybdenum alloys, Tungsten, etc. In accordance with another embodiment of the present invention, the initiator tip is encased in an insulative material to eliminate any possibility of electric shock to a person handling the initiation device.

25 Claims, 4 Drawing Sheets

SHOCK TUBE INITIATOR TIP ENCASED IN A NON-CONDUCTIVE MATERIAL

CROSS REFERENCE TO RELATED APPLICATION

This application claims the benefit of the filing date of U.S Provisional Application Serial Number 60/091,998, filed Jul. 8, 1998, which is hereby incorporated by reference into the present disclosure.

TECHNICAL FIELD OF THE INVENTION

The present invention relates to the blasting industry and, more particularly, to an initiation device for use with non-electric shock tubes.

BACKGROUND OF THE INVENTION

It is known in the blasting industry to use initiation devices for initiating shock tube which, in turn, ignites a base charge. The shock tube contains a small quantity of gun powder that is ignited by a powerful percussion spark generated by the initiation device. The initiation of the gun powder causes the base charge coupled to the remote end of the shock tube to be ignited. This type of shock tube is commonly referred to as non-electric shock tube due to the fact that gun powder rather than electricity is used to ignite the base charge.

Conventional non-electric shock tube initiation devices used in the blasting industry include an initiator tip which contains electrical components for generating the spark that initiates the gun powder in the shock tube. The typical initiator tip comprises a standard coaxial cable connector and relies on generating a differential voltage between the inner conductor of the coaxial cable and the outer conductor of the coaxial cable to create the percussion spark.

One disadvantage of the conventional non-electric shock tube initiation device is that the inner electrode of the coaxial cable connector is comprised of copper, which is easily damaged by the high-temperatures produced by the percussion spark. Consequently, repeated firing of the initiation device destroys the tip of the inner electrode, which is housed in the initiator tip of the initiation device and which couples with the shock tube.

Another disadvantage of the conventional non-electric shock tube initiation device is that the coaxial cable connector that functions as the initiator tip is made of a conductive material. Therefore, if a person touches the initiator tip while current is being applied to the electrodes, the person will receive a high-voltage shock, thereby risking serious bodily injury and possibly death.

Accordingly, a need exists for an initiator tip for use with a non-electric shock tube initiation device which utilizes an inner electrode made of a relatively high-temperature conductive material that can withstand the high temperatures associated with firing the tip. A need also exists for an initiator tip which comprises an outer encasing made of an insulative material for eliminating the possibility of electric shock to a person using the initiation device.

SUMMARY OF THE INVENTION

The present invention provides a non-electric initiator tip for use with a nonelectric shock tube initiation device. The initiator tip of the present invention comprises an inner electrode, an outer electrode, and a conductive component electrically coupled to the inner and outer electrodes for applying current to the inner and outer electrodes to thereby cause a percussion spark to be generated. When the initiator tip is connected to an initiation device, the conductive component of the initiator tip is electrically coupled to electronics in the initiation device such that, when the initiation device is actuated, the electronics in the initiation device in conjunction with a power supply cause a voltage differential to be generated between the inner and outer electrodes and a percussion spark to be produced. The percussion spark initiates gun powder contained in a shock tube mounted to the initiator tip.

In accordance with one embodiment of the present invention, the initiator tip comprises an inner electrode made of a material having a high melting point, such as, for example, steel/nickel alloys (e.g., stainless steel SS-304, SS-306), chromium/molybdenum alloys, Tungsten, etc. In accordance with another embodiment of the present invention, the initiator tip is encased in an insulative material to eliminate any possibility of electric shock to a person handling the initiation device. In accordance with this embodiment, the inner electrode can be comprised of any conductive material, such as, for example, copper, although preferably a high-temperature material is used for this purpose.

In accordance with the preferred embodiment of the present invention, the initiator tip of the present invention comprises the features of the first and second embodiments, i.e., the inner electrode of the initiator tip is made of a material having a high melting point, such as, for example, steel/nickel alloys (e.g., stainless steel SS-304, SS-306), chromium/molybdenum alloys, Tungsten, etc., and the initiator tip is encased in an insulative material to eliminate any possibility of electric shock to a person handling the initiation device.

In accordance with another embodiment of the present invention, the initiator tip of the present invention comprises a conventional coaxial cable initiator tip encased in an insulative material to reduce the possibility of electric shock to a person handling the initiator tip.

These and other advantages of the present invention will become apparent from the following description, drawings and claims.

DETAIL DESCRIPTION OF THE INVENTION

Figure 1:
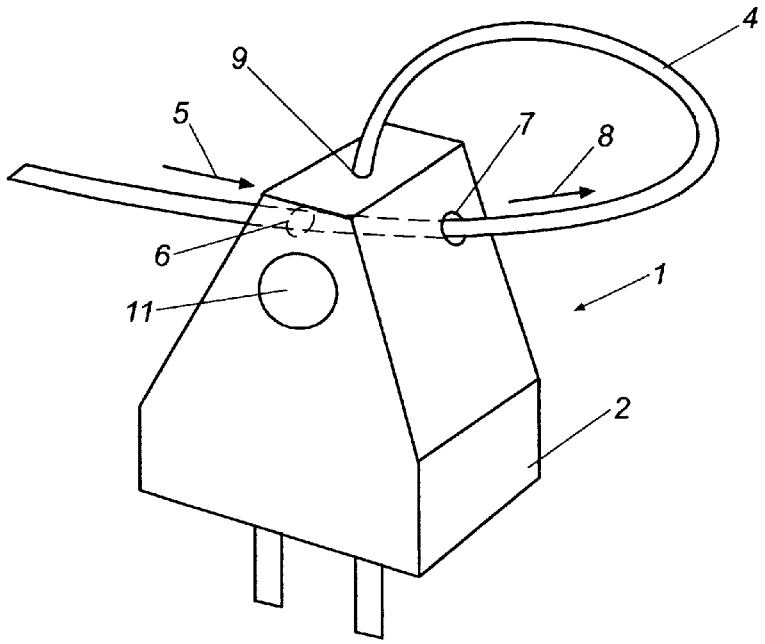
FIG. 1 is a perspective view of the initiator tip of the present invention in accordance with the preferred embodiment.

FIG. 1 is a perspective view of the initiator tip 1 of the present invention in accordance with the preferred embodiment. In accordance with the preferred embodiment of the present invention, the initiator tip 1 comprises several components, as discussed below in detail, all of which are encapsulated either wholly or partially within a casing 2, in accordance with the preferred embodiment, which is comprised of a non-conductive material. The non-conductive material of the casing 2 is not limited to any particular type of non-conductive material, but may be, for example, clay, ceramic, plastic, glass, wood, asbestos, a fiber/glue mixture, porcelain, etc. However, it will be understood by those skilled in the art that any non-conductive material having a suitable mechanical stability for encasing the components of the initiator tip is suitable for this purpose. It should be noted that it is not necessary that the casing 2 be comprised of a non-conductive or insulative material. The initiator tip 1 will function as expected regardless of the insulative or conductive characteristics of the casing 2.

The manner in which the casing 2 is manufactured is not limited to any particular process. The casing 2 may be machined in a post-processing operation after it is molded or the mold for the casing 2 may be relieved in certain areas during molding to allow access to the components comprised within the casing 2.

In FIG. 1, a section of shock tube 4 is shown connected to the initiator tip. The section of shock tube 4 enters the initiator tipl from a direction indicated by the arrow 5 through a first opening 6 in the casing 2 and then passes out of the casing through an opening 7 formed in the casing 2 in the direction indicated by arrow 8. The shock tube 4 then wraps around and passes through a third opening 9 formed in the casing 2. The end of the shock tube 4 that passes through the opening 9 is then inserted over the concentric outer and inner electrodes (not shown) of the electrode assembly (not shown) such that when a percussion spark is generated between the inner and outer electrodes, gun powder (not shown) contained within the shock tube will be ignited.

The manner in which the shock tube passes through the openings 6, 7 and 9 in the casing 2 before being inserted over the inner and outer electrodes provides strain relief which firmly maintains the shock tube 4 in position over the inner and outer electrodes. The openings 6, 7 and 9 formed in the casing 2 are large enough in diameter that they can receive shock tubes that are relatively large in diameter. The sizes of the diameters of the holes formed in casing for receiving the shock tube 4 are not limited to any particular sizes. One of the features of the initiator tip 1 of the present invention is that the openings 6, 7 and 9 formed in the casing 2 for receiving the shock tube 4 accommodate shock tubes of various diameters, preferably shock tubes ranging in diameter from approximately 0.080 inches to approximately 0.142 inches.

Conventional initiator tips rely on inserting the shock tube through an opening that is large enough to receive the shock tube but small enough to form a friction fit between the opening and the shock tube to thereby hold the shock tube in position over the electrode assembly. Therefore, in the conventional initiator tips, strain relief is provided by the friction fit created between the opening for receiving the shock tube and the shock tube itself. In contrast, in accordance with the present invention, strain relief is provided by the manner in which the shock tube passes horizontally through the two openings 6 and 7 formed in the casing 2 and then is wrapped around and passed vertically through the upper opening 9 formed in the casing and then over the electrode assembly. Therefore, in accordance with the present invention, strain relief for maintaining the shock tube in position is not provided by a friction fit between the shock tube and the openings, but rather, results from the manner in which the shock tube is wound through and wrapped about the casing 2, as well as spring-like characteristics of the shock tube. Opening 11 formed in the casing 2 is larger than the openings 6, 7 and 9 for receiving the shock tube 4 and allows a user to view the electrode assembly which is disposed within opening 11. Opening 11 passes through the entire width of the casing 2.

Figure 2A:
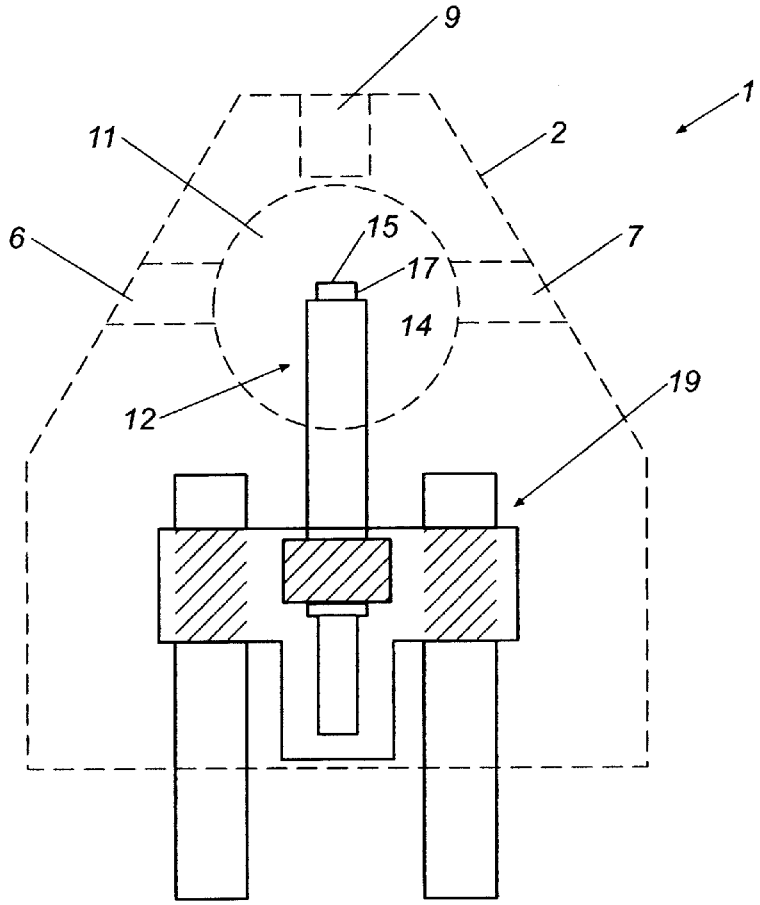
FIG. 2A is a cross-sectional plan view of the initiator tip shown in FIG. 1.
Figure 2B:
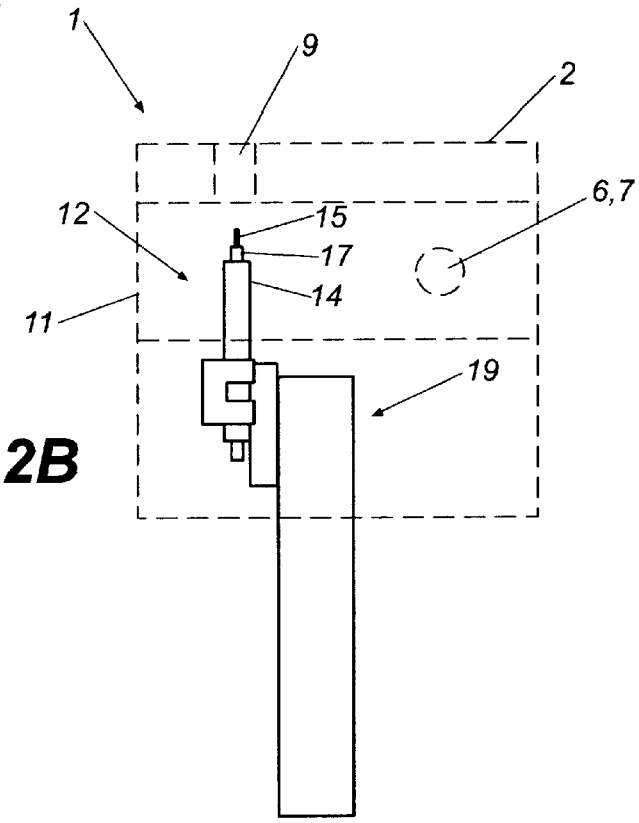
FIG. 2B is a side plan view of the initiation tip shown in FIG. 1.

FIG. 2A is a cross-sectional plan view of the initiator tip 1 which illustrates, through opening 11, the electrode assembly 12 comprising an outer electrode 14 which is separated from an inner electrode 15 by an insulative sleeve 17. FIG. 2B is a side plan view of the initiation tip 1 which demonstrates the locations of the openings 6, 7, 9, and 11 with respect to each other. The electrode assembly 12 is coupled to an electrical initiation assembly 19, which is discussed below in more detail. The opening 11 is sufficiently large to enable a user to view the electrode assembly 12 as an end of the shock tube is inserted over the end of the electrode assembly 12, but sufficiently small to prevent a finger from being able to contact the electrode assembly.

Figure 3A:
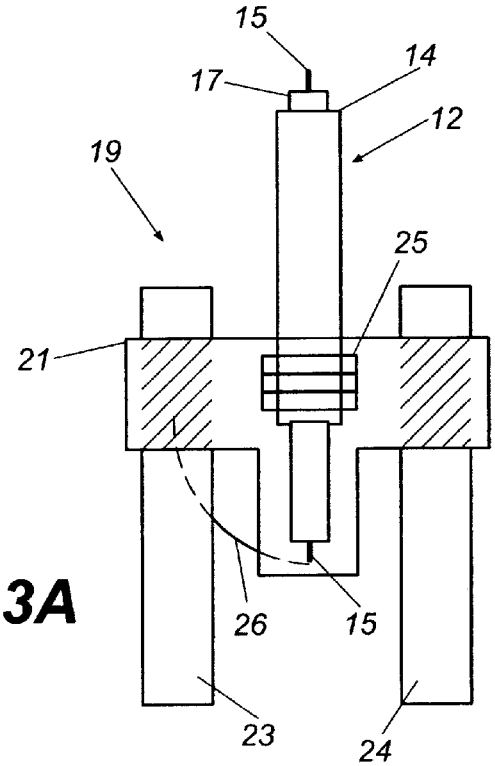
FIG. 3A is a front plan view of the electrical initiation assembly and of the electrode assembly of the initiator tip shown in FIG. 1 without a casing.

FIG. 3A is a front plan view of the electrical initiation assembly 19 and of the electrode assembly 12 without the casing 2. The electrical initiation assembly 19 comprises a mounting board 21 and two primary contacts 23 and 24. The portion of the inner electrode 15 seated within the electrical initiation assembly 19 is in electrical contact with primary contact 23 via lead 26 whereas the outer electrode 14 is in electrical contact with primary contact 24 via a conductive contact not shown in FIG. 3A, but which is discussed below in detail.

Figure 3B:
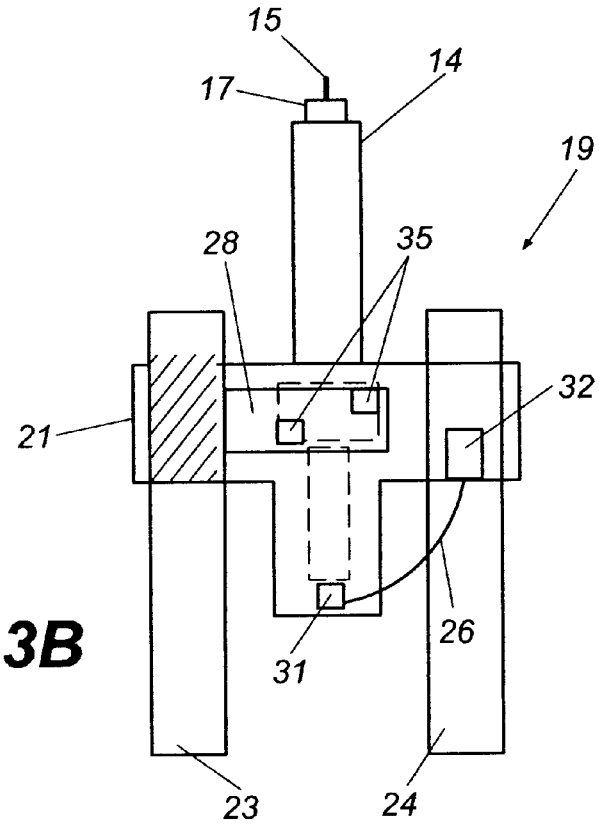
FIG. 3B is a back plan view of the initiation tip shown in FIG. 1 without the casing which illustrates the manner in which the inner and outer electrodes are electrically coupled to the primary contacts.

FIG. 3B is a back plan view of the initiation tip 1 without the casing 2 which shows the manner in which the inner and outer electrodes 15 and 14 are electrically coupled to the primary contacts 23 and 24, respectively. The primary contact 24 preferably is electrically coupled to a conductive coil mounting bracket 7 of electrode assembly 12 via a contact area 28 comprised in the mounting board 21. The center electrode 15 is attached at its proximal end to a contact area 31 which is electrically coupled to primary contact 23 at contact area 32 by conductive lead 26. It should be noted that the present invention is not limited with respect to the manner in which the electrical contacts are made between the primary contacts 24 and 23, and the outer and inner electrodes 14 and 15, respectively. Preferably, the electrical contacts between these components are made by welding, soldering, pressure bonding and/or crimping. However, it will be apparent to those skilled in the art that the manner in which the electrical contacts are made is not limited to any particular process or material. To facilitate mass production of the initiation tip 1 of the present invention, the mounting board 21 of the electrical assembly preferably is fabricated with electrical contacts 28, 31 and 32 embedded therein. Once the electrode assembly 12 has been inserted into the mounting board 21, and ends (not shown) of mounting bracket 7 have been electrically coupled to contact points 35, a conductive path is established between the primary contact 23 and the outer electrode 14. Lead 26 is then attached to contact areas 31 and 32. However, it should be noted that this configuration is for convenience and efficiency and that the present invention is not limited to such a configuration.

Figure 4:
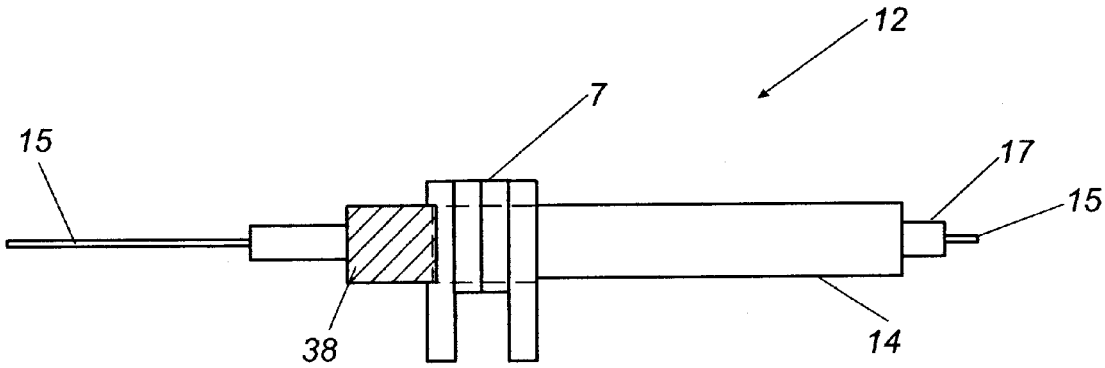
FIG. 4 is a side view of the electrode assembly of the initiator tip of the present invention shown in FIG. 1.

FIG. 4 is a side view of the electrode assembly 12 of the present invention in accordance with the preferred embodiment. In accordance with the preferred embodiment of the present invention, the conductive mounting bracket 7 conforms to the outer surface of the outer electrode 14. The mounting bracket 7 may be fashioned from any conductive material such as, for example, brass, tin, steel, aluminum, copper, lead, etc. The mounting bracket 7 may be attached to the outer electrode 14 by any suitable method such as, for example, welding, soldering, pressure bonding or crimping, provided that a good electrical contact, i.e., a low-resistance electrical contact, is made between the outer electrode 14 and the mounting bracket 7. The darkened area 38 on the outer electrode 14 is intended to represent the electrical attachment between the outer electrode 14 and the mounting bracket 7.

Figure 5:
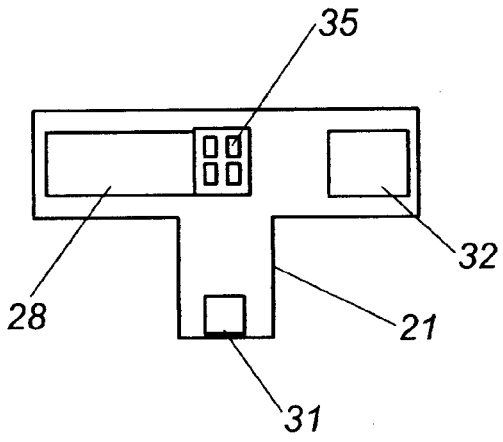
FIG. 5 illustrates a plan view of the mounting board upon which the electrode assembly shown in FIG. 4 is mounted.

FIG. 5 illustrates a plan view of the mounting board 21 by itself. When the mounting board 21 is manufactured, electrical contacts 28, 31 and 32 are formed in the mounting board 21. The holes designated by numeral 35 in FIG. 5 represent locations where the ends of the mounting bracket 7 shown in FIG. 4 are inserted through contact 28 and welded, or pressure bonded, etc., to electrical contact area 41 after the electrode assembly 12 has been mounted in the mounting board 21. Alternatively, the mounting bracket 7 may be seated in the mounting board 21 and connected to contact area 28 at points 35 and then the electrode assembly 12 may be attached to the mounting bracket 7.

Once the electrode assembly 12 has been mounted in the mounting board 21, the proximal end of the inner electrode 15 will be in contact with electrical contact area 31. Once the primary contacts 23 and 24 have been mounted in the mounting board 21 at the locations shown in FIGS. 3A and 3B, the primary contacts 23 and 24 will be electrically coupled to electrical contact areas 41 and 43, respectively. The primary contacts 23 and 24, the inner electrode 15, the lead 26 and the mounting bracket 7 preferably are welded, soldered, pressure bonded or crimped to their respective electrical contact areas 28, 31 and 32. Once the electrode assembly 12 has been mounted on mounting board 21 and all electrical contacts are established, the casing 2 is molded about the components of the initiator tip 1. It will be understood by those skilled in the art that casing 2 can be formed by methods other than molding, such as machining, for example. It should also be noted that the present invention is not limited with respect to the manner in which the casing 2 is secured about the components of the initiator tip. For example, the casing 2 and the mounting board 21 could be threaded so that the casing 2 could be screwed onto the mounting board 21.

Figure 6:
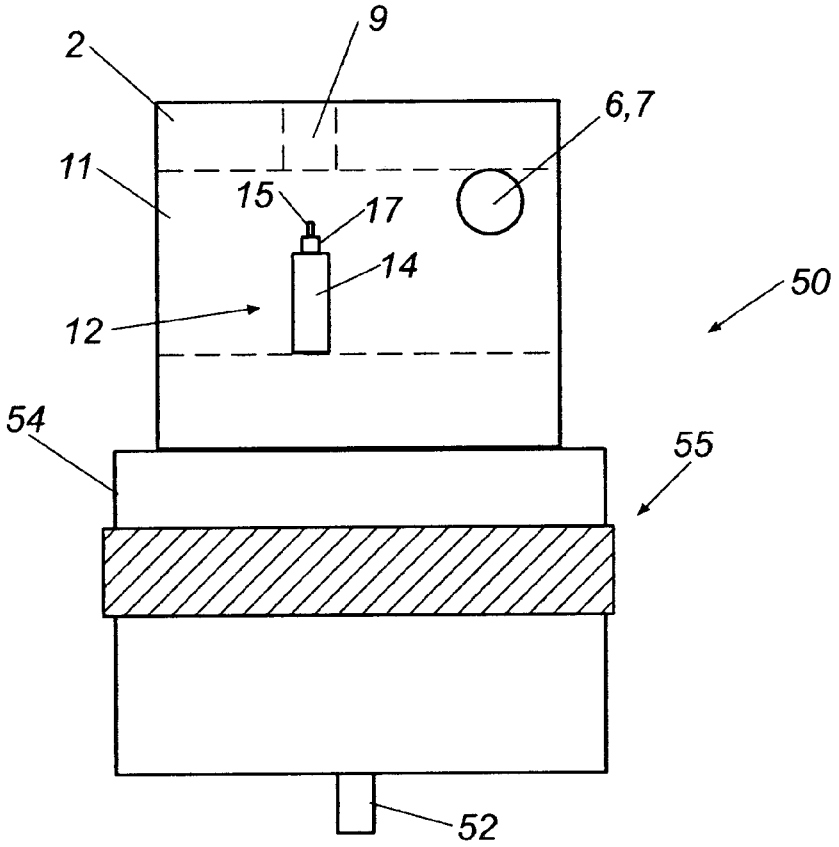
FIG. 6 illustrates an alternative embodiment of the present invention wherein the initiator tip of the present invention utilizes the center pin and the outer shell of a coaxial connector as the primary contacts.

FIG. 6 illustrates an alternative embodiment of the present invention wherein an electric initiator tip 50, which utilizes the center pin 52 and the outer shell 54 of a coaxial connector 55 as the primary contacts, is connected to an electrode assembly, which may be identical to the electrode assembly 12 described above with respect to FIGS. 2A–4. The electrode assembly 12 is encompassed within a non-conductive casing, which may be identical to the casing 2 described above with respect to FIGS. 1, 2A and 2B. In accordance with this embodiment of the present invention, the inner and outer electrodes of the electrode assembly 12 are connected to the center pin 52 and outer shell 54 of the coaxial connector 55 in any desired manner in order to provide electrical contact between the center pin 52 and the inner electrode 15 and between the outer shell 54 and the outer electrode 14. The manner in which this can be accomplished will be understood by those skilled in the art and, therefore, in the interest of brevity, a detailed discussion of the electrical connections between these components will not be provided herein. The coaxial connector 55 can be anyone of a variety of different types, such as, for example, F connectors, N connectors, TNC connectors, BNC connectors, HF connectors, TWINAX connectors, an RCA phone jack, a 3 mm-battery connector, a phono plug, and SNB-style connectors. The casing 2 preferably has openings formed therein which are identical to the openings shown and discussed above with respect to FIGS. 1–2B. Opening 11 is indicated by dashed lines and preferably is identical to opening 11 shown in FIG. 2A so that a user can see the electrode assembly 12 as the shock tube (not shown) is inserted over the electrode assembly 12. The openings 6, 7 and 9 provide strain relief for the shock tube in the manner discussed above with respect to FIG. 1.

It will be understood by those skilled in the art that, although the present invention has been described with respect to certain embodiments, the present invention is not limited to these embodiments. For example, the design of the mounting board discussed above is not limited to any particular design and those sloped in the art will understand that virtually an infinite number of designs are suitable for this purpose. It should also be noted that the present invention is not limited to any particular design for the electrode assembly. The preferred design for the electrode assembly was discussed above for purposes of demonstrating the concepts of the present invention and the preferred manner in which the initiator tip 1 of the present invention is constructed. Also, it should be noted that the openings 6, 7 and 9 in the casing 2 which provide strain relief, as well as access to the electrode assembly for connecting the shock tube to the electrode assembly, are not limited to any particular locations in the casing 2. Furthermore, it is not necessary that openings 6 and 7 in the casing be provided. If the shock tube is substantially the same diameter as opening 9 in the casing 2, a friction fit will be created between the shock tube and opening 9 such that once the end of the shock tube has been placed over the electrode assembly, the shock tube will be maintained in position due to the friction fit between the opening 9 and the outer surface of the shock tube. Other modifications can be made to the embodiments discussed above which are within the spirit and scope of the present invention.

What is claimed is:

1. An initiator tip for use with an initiation device for initiating an explosive material contained within a shock tube, the initiator tip comprising:

an electrode assembly, the electrode assembly comprising concentric inner and outer electrodes, the inner electrode being disposed within the outer electrode and insulated from the outer electrode by an insulative material;

first and second primary electrical contacts, each of said primary contacts having a first end and a second end, the first end of the first primary contact being conductively coupled to the outer electrode, the first end of the second primary contact being conductively coupled to the inner electrode, the second ends of the primary contacts being disposed for connection to an initiation device such that when an initiation device connected to the second ends of the primary contacts produces a differential voltage between the primary contacts, a percussion spark is generated at distal ends of the inner and outer electrodes, wherein the inner electrode is comprised of a material having a relatively high melting point.

2. The initiator tip of claim 1, wherein the inner electrode is comprised of a steel/nickel alloy.

3. The initiator tip of claim 1, wherein the inner electrode is comprised of a chromium/molybdenum alloy.

4. The initiator tip of claim 1, wherein the inner electrode is comprised of Tungsten.

5. The initiator tip of claim 1, further comprising a casing for encasing the electrode assembly and the first ends of the first and second primary contacts, the casing having at least a first side wall, a second side wall, a bottom end wall and a top end wall, the first and second side walls each having an opening formed therein for receiving a section of shock tube, the casing having a hollow section extending between the openings in the side walls to allow the section of shock tube to pass through the casing, the opening in the upper end wall of the casing being located above the electrode assembly, the casing being hollow between the opening in the upper end wall and the electrode assembly to allow an end of the shock tube to be inserted through the opening in the upper end wall and over a distal end of the electrode assembly such that the end of the shock tube surrounds the distal ends of the inner and outer electrodes, and wherein the opening formed in the bottom end wall of the casing provides access to the second ends of the first and second primary contacts.

6. The initiator tip of claim 5, wherein the casing has an opening formed in a front wall thereof which allows a user to view the distal end of the electrode assembly as the shock tube is inserted over the distal ends of the inner and outer electrodes.

7. The initiator tip of claim 5, wherein the casing is comprised of a non-conductive material.

8. The initiator tip of claim 7, wherein the casing is comprised of plastic.

9. The initiator tip of claim 8, wherein the casing is comprised of a ceramic material.

10. The initiator tip of claim 9, wherein the casing is comprised of glass.

11. The initiator tip of claim 10, wherein the casing is comprised of clay.

12. The initiator tip of claim 11, wherein the casing is comprised of a mixture of fiber and glue.

13. The initiator tip of claim 12, wherein the casing is comprised of porcelain.

14. An initiator tip for use with an initiation device for initiating an explosive material contained within a shock tube, the initiator tip comprising:

an electrode assembly, the electrode assembly comprising concentric inner and outer electrodes, the inner electrode being disposed within the outer electrode and insulated from the outer electrode by an insulative material;

first and second primary electrical contacts, each of said primary contacts having a first end and a second end, the first end of the first primary contact being conductively coupled to the outer electrode, the first end of the second primary contact being conductively coupled to the inner electrode, the second ends of the primary contacts being disposed for connection to an initiation device such that when an initiation device connected to the second ends of the primary contacts produces a differential voltage between the primary contacts, a percussion spark is generated at distal ends of the inner and outer electrodes.

15. The initiator tip of claim 14, wherein the inner electrode is comprised of a steel/nickel alloy.

16. The initiator tip of claim 14, wherein the inner electrode is comprised of a chromium/molybdenum alloy.

17. The initiator tip of claim 14, wherein the inner electrode is comprised of Tungsten.

18. The initiator tip of claim 14, wherein the casing has at least a first side wall, second side wall, a bottom end wall and a top end wall, the first and second side walls each having an opening formed therein for receiving a section of shock tube, the casing having a hollow section extending between the openings in the side walls to allow the section of shock tube to pass through the casing, the opening in the upper end wall of the casing being located above the electrode assembly, the casing being hollow between the opening in the upper end wall and the electrode assembly to allow an end of the shock tube to be inserted through the opening in the upper end wall and over a distal end of the electrode assembly such that the end of the shock tube surrounds the distal ends of the inner and outer electrodes, and wherein the opening formed in the bottom end wall of the casing provides access to the second ends of the first and second primary contacts.

19. The initiator tip of claim 18, wherein the casing has an opening formed in a front wall thereof which allows a user to view the distal end of the electrode assembly as the shock tube is inserted over the distal ends of the inner and outer electrodes.

20. The initiator tip of claim 18, wherein the casing is comprised of plastic.

21. The initiator tip of claim 18, wherein the casing is comprised of a ceramic material.

22. The initiator tip of claim 18, wherein the casing is comprised of glass.

23. The initiator tip of claim 18, wherein the casing is comprised of clay.

24. The initiator tip of claim 18, wherein the casing is comprised of a mixture of fiber and glue.

25. The initiator tip of claim 18, wherein the casing is comprised of porcelain.

* * * * *